US007611129B1

(12) United States Patent
Stahm

(10) Patent No.: US 7,611,129 B1
(45) Date of Patent: Nov. 3, 2009

(54) TENSION TESTING ANCHOR LOCK

(75) Inventor: William G. Stahm, Brighton, CO (US)

(73) Assignee: Foresight Products, LLC, Commerce City, CO (US)

( * ) Notice: Subject to any disclaimer, the term of this patent is extended or adjusted under 35 U.S.C. 154(b) by 0 days.

(21) Appl. No.: 12/283,936

(22) Filed: Sep. 17, 2008

(51) Int. Cl.
*B21F 9/00* (2006.01)

(52) U.S. Cl. ..... 254/243; 254/244; 254/256; 254/263

(58) Field of Classification Search ..... 254/230, 254/237, 243, 244, 246, 248, 249, 256, 30, 254/263
See application file for complete search history.

(56) References Cited

U.S. PATENT DOCUMENTS

| | | | | | |
|---|---|---|---|---|---|
| 972,306 | A | * | 10/1910 | Wilcox | 52/163 |
| 1,666,454 | A | * | 4/1928 | Johnson | 254/132 |
| 3,048,368 | A | * | 8/1962 | Linabery, Sr. | 254/130 |
| 3,254,876 | A | * | 6/1966 | Powell | 254/132 |
| 3,665,717 | A | * | 5/1972 | Sweeney et al. | 405/259.5 |
| 4,096,673 | A | | 6/1978 | Deike | |
| 4,250,769 | A | * | 2/1981 | Herring | 74/525 |
| 4,574,539 | A | * | 3/1986 | Deike | 52/163 |
| 4,611,446 | A | * | 9/1986 | Beavers et al. | 52/163 |
| 4,802,317 | A | * | 2/1989 | Chandler | 52/163 |
| 5,022,632 | A | * | 6/1991 | Beideck | 254/30 |
| 5,383,749 | A | * | 1/1995 | Reisdorff et al. | 405/232 |
| 5,464,192 | A | * | 11/1995 | Burnham | 254/30 |
| 5,499,795 | A | * | 3/1996 | Mathews | 254/30 |
| 6,527,250 | B1 | * | 3/2003 | Tyson | 254/30 |
| 7,125,000 | B1 | * | 10/2006 | Saavedra et al. | 254/30 |

* cited by examiner

*Primary Examiner*—Emmanuel M Marcelo
(74) *Attorney, Agent, or Firm*—Dennis A. Gross; The Hill Firm

(57) ABSTRACT

A device for rotating, setting and locking driven pivotal ground anchors and for applying a predetermined tension to test load the locked anchor, comprises a horizontal base plate having an opening through which an anchor rod or cable can project, an upright post extending from the base terminating in a moveable arm carried by the post, which can be attached to the anchor cable through an intermediary cable, chain, or other fastener. The arm is rotatable through a socket drive rotatably carried at the top of the post, which can be actuated by a hand or power torsion wrench to cause rotation of the arm, to draw the anchor up, to rotate it in the ground to its set position and to apply a predetermined tension determined by the setting of the torque wrench to thereby proof test the holding power of the anchor. Various means can be provided to secure the anchor under tension.

16 Claims, 3 Drawing Sheets

62
60
50
61
65
66
18
16
91
20
11

109
34
108
16
100
105
47
106
30
101
104

TENSION TESTING ANCHOR LOCK

BACKGROUND OF THE INVENTION

1. Field of the Invention

This invention relates to ground anchors and more specifically to devices and methods for pivoting, setting and loading driven ground anchors.

2. Background

Ground anchors or earth anchors of the driven and pivoting or tilting type are well known and generally include a main body portion having a leading edge adapted to be driven into the ground by a drive rod, a trailing edge including an outturned lip and a tensioning connection such as a cable rod or guide wire attached to a point intermediate the leading and trailing edges generally positioned from about the midpoint of the overall length of the anchor or towards the trailing edge. Upon exertion of a withdrawal force on the cable, rod or wire (herein cable), after driving of the anchor into the ground, the trailing edge outturned lip will bite into the earth causing the anchor to rotate or pivot to a set position generally at a right angle to the wire attached to the anchor.

In order to apply a force to the tensioning connection member, whether it is a rod end attached to the anchor or a cable or a guide wire, structures capable of applying an upward pull are used. It will be understood that throughout this specification and in the claims that the terms upward, vertical, horizontal or the like are used to describe the respective directions when the anchor is driven downwardly into the ground from a generally horizontal surface. Such terms should be understood to apply respectively to other orientations where, for example, the anchor may be driven into the ground at an angle and where the tension force applied to the anchor will be applied at an angle to the horizontal, or even those situations where the anchor is driven horizontally into the ground, for example when setting a revetment or retaining wall. It is therefore intended that directional terms used in this document are relative dependent upon the installation and such terms should be construed appropriately to each differing installation. These structures may range from simple hand grasped devices to pull up on the cable of small anchors to high pressure hydraulic ram structures for use with large anchors. Such driven pivoting anchors are available from the assignee of this application, Foresight Products, LLC, of 6430 East 49$^{th}$ Drive, Commerce City, Colo. 80022, and range in size from small Duckbill® anchors (trademark of Foresight Products, LLC), which may be only a few inches in length, to large Stingray® and Mantaray® anchors (trademarks of Foresight Products, LLC), which may have a side-to-side span of a foot or greater in length and an axial length greater than a foot, and which may require the application of 10 to 20 tons of tensioning force to proof test the holding power of the anchor.

For small to medium size anchors, however, rotation of the anchor setting and loading locking it has generally been accomplished by relatively unsophisticated and tension force pressure guessing means. It has been common, for example, to use automobile ratcheting car jacks over which a cable has been looped and then tied to the ends of the anchor cable so that upon ratcheting of the car jack the moving jack member will pull up on the anchor cable. Obviously when the car jack, being hand operated, is no longer moving easily, it can be said that the anchor setting has been proof tested, however there is no measurement of the force applied, and that force will vary considerably depending upon the length of the lever arm used to operate the jack and the strength of the person pressing down on the lever arm.

While hydraulic ram devices can be equipped with pressure cages to give an instantaneous readout of the pressure applied to the anchor cable or rod, as the case may be, generally for smaller mechanical or hand operated tension loading devices it has been difficult to determine when the anchor has been tested to its desired set point.

It would therefore be an improvement in the art to provide an inexpensive anchor setting, locking, loading, and proof testing structure and method of load locking and proof testing of such driven rotatable earth anchors.

SUMMARY OF THE INVENTION

The instant invention utilizes a standard adjustable torque wrench, or a torque settable electric or pneumatic wrench or ratcheting driver to rotate a lever arm positioned atop an upright post extending up from a base. The lever arm can be attached directly to, or a have a cable which is attached to, the anchor cable, rod or wire. The arm is rotatable with respect to the base and the upright post structure and can be rotated by a standard torque wrench, which can be preset to a predetermined torque load, which when applied a the socket attached to the lever arm will create a predetermined lifting or tension force on the anchor cable. It will therefore be understood that in dimensioning a device according to this invention, the arm will ideally have a length where a relatively small arc movement, less than 180°, of the arm will cause the anchor to pivot to its set position and that further force tending to rotate the arm will thereafter apply a tension load to the anchor to proof test the anchor.

Because the pivoting to set earth anchors such as the Duckbill® anchors available from Foresight Products, LLC normally rotate or pivot to their set or locked position in a vertical movement approximately equal to or less than the length of the anchor the actual arc of movement of the lever arm may only be on the order of 45-120°, depending on the length of the arm. It would be understood that the arm could be moved through a range of approximately 180° from a cable attached end down to a cable attached arm end straight up position, which would represent then the maximum lift of the anchor cable for an arm of a given length.

In order to accommodate different lengths of anchor cable, or different depths of driving of the anchor, or in some instance to accommodate a greater upward movement of the anchor before it is locked, the upright extending upward from the base to the pivoting arm connection may be adjustable in height and could be repositioned during a load locking operation if upon 180° of arm movement the anchor is not set.

In an embodiment of the invention, a base plate is provided which is generally rectangular and which supports a telescoping post structure which may be vertically adjustable and which terminates at its top in a rotatable socket carried by the post. The socket has an arm extending from it, which is rotatable with the socket. The socket may have an end opening for receipt of the attachment post of a standard socket wrench. By applying a wrench to the socket, the socket can be rotated with respect to the upright and base and the arm projecting from the socket will therefore have its end remote from the socket rotated through an arc.

In an embodiment of the invention, a base member is provided with a slot or opening therethrough for receipt of the cable of a ground anchor that has been driven into the ground, an upright post which is vertically adjustable and which may be set at an angle to the base extends from and is attached to the base and terminates at an end opposite the base in a holder for a rotatable socket. Affixed to the socket or a member rotating with the socket is an arm that projects outwardly from the base and which is generally more or less horizontally aligned with the slot or opening in the base. The end of the arm carries a clevis or other means for affixing a cable, chain, or other structure which depends from the arm and is moveable relative to the arm and which can terminate in a hook or other attachment to an eye or loop formed on the end of the anchor cable. The socket can be rotated by a standard wrench, a pneumatic wrench or an electric driven wrench, preferably of the type where the drive connection from a wrench can be adjusted to apply a predetermined maximum torque.

In an embodiment of the invention, an anchor setting load locker and proof tester is provided which consists of a base member with a telescoping upright extending from the base member causing a rotatable member having a projecting arm affixed thereto having an end moveable towards and away from the base and a means for attachment of a manual or powered adjustable torque wrench, which when moved to rotate the rotatable member at the top of the upright, or at a position along the upright spaced from the base, the rotatable member having an arm extending outwardly therefrom will cause the arm to pull on the anchor cable to initially set the anchor and to thereafter apply a load to the anchor until the torque setting has been reached. A cable lock member may then act to prevent withdrawal of the cable or slacking of the cable between the anchor and the top of the ground, allowing the excess length of the cable sticking from the ground to be cut off upon release of the lifting pressure of the rotatable arm.

In an embodiment of the invention a base member is provided having a height adjustable upright extending from the top surface of the base and terminating at an end remote from the base. The end remote from the base carries a rotatable arm projecting from the upright, which is rotatable under a torque applied to a rotating member carried by the upright and attached to the arm from a torque adjustable driver. A ratchet and pawl or other locking means is provided between a stationary portion carried by the upright and the rotatable portion to hold the rotatable portion in a rotated position until intentionally released. The arm extending from the rotatable portion terminates in a connection for connection to the cable, rod or wire attached to the anchor, which has been driven into the ground. Actuation of force from the torque applying driver will cause a rotation of the arm away from the base, which will apply an upward movement and tension to the anchor cable to a maximum degree determined by the setting on the torque applying device. The ratchet and pawl or similar locking device will prevent counter rotation of the arm until it is released.

It is therefore an object of this invention to provide an inexpensive anchor setting load locker and proof testing device for use with driven pivotal ground anchors which can be hand operated utilizing a torque wrench presettable to a predetermined torsion force which will apply a predetermined tension force to the anchor cable.

It is another object of this invention to provide an anchor locking and tension load testing structure for use with ground anchors of the pivoting type which consists of a base member positionable atop the ground or atop a member to be held to the ground by the anchor and which includes a height adjustable upright member terminating at or adjacent its end remote from the base in a rotating structure affixed to the upright but rotatable with respect thereto, the rotatable structure being actuatable by a torque wrench or similar adjustable torque applying tool to rotate a lifting arm fixed to the rotatable structure, the lifting arm having an attachment adjacent a free end remote from the upright to attach the arm to the cable or rod of the anchor, whereby upon application of torsion force from the torsion wrench or other torsion applying device to the rotatable member, the arm will pull up on the anchor cable or rod to cause the anchor to rotate to a set locked position and will then apply a tension force to the cable determined by the setting on the torsion wrench. Means may be provided to hold the arm in a tension applying position to allow the cable to be fixed in position through means such as a crimp sleeve or a one-way cable wedge lock, which may be carried on a base member positioned beneath the base of the structure.

These and other objects of the invention will be apparent to those of ordinary skill in the art from a description of the preferred embodiment, it being understood that the description is of one such structure for applying an anchor locking and proof testing force to a ground anchor and that other structures and methods may be employed utilizing the teachings of this invention.

DESCRIPTION OF THE PREFERRED EMBODIMENT

Figure 1:
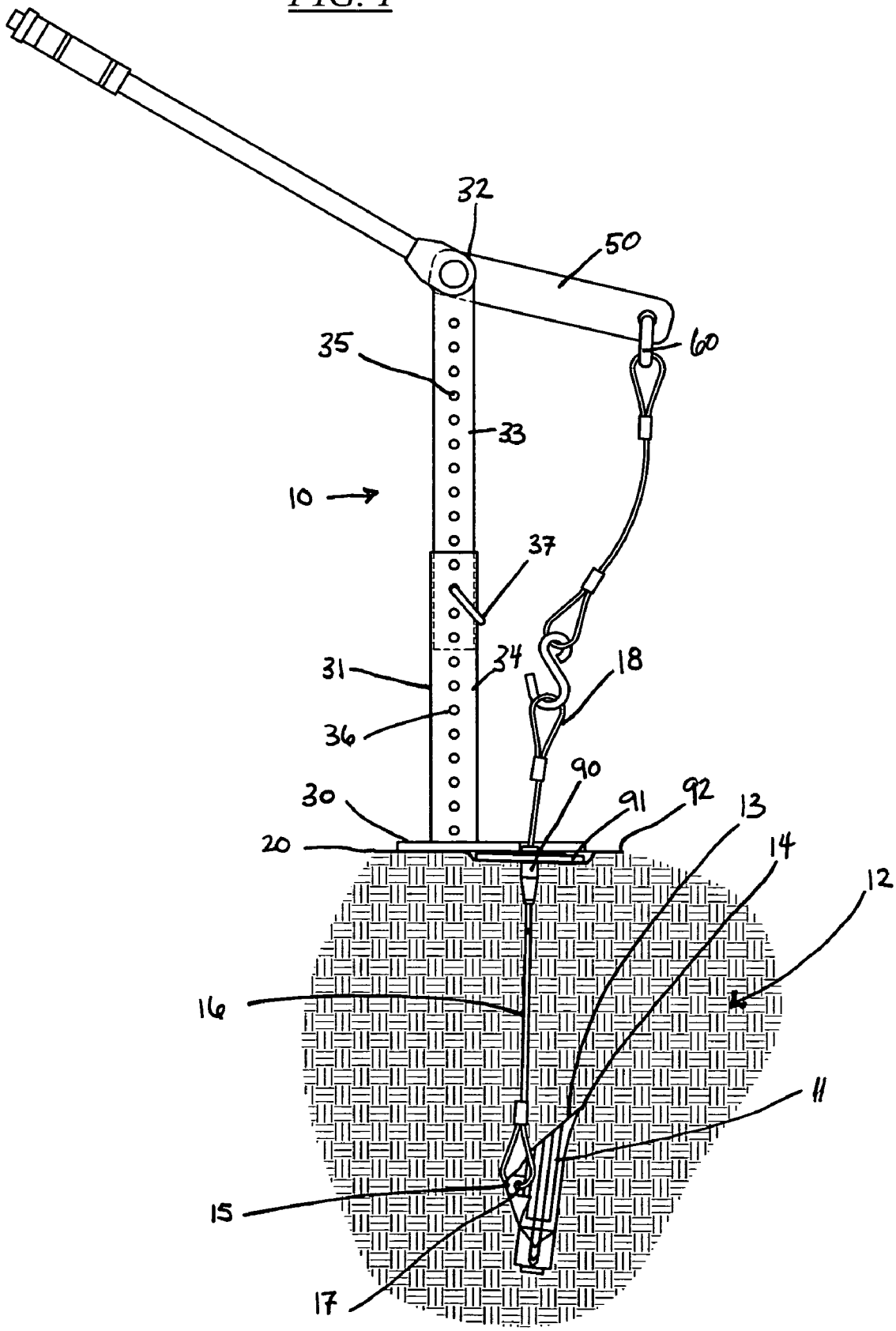
FIG. 1 is a partially schematic side view of an anchor setting load locker and tension proof testing structure according to this invention with an anchor shown as positioned in the as-is driven condition in the ground, prior to a load being applied.

FIG. 1 illustrates an anchor load locker and tension proof testing structure 10 for locking and testing a ground anchor 11 after it has been driven into the ground 12. The anchor shown is generally of the Duckbill type or a planing fin anchor style shown, for example, in U.S. Pat. No. 3,969,854, or in U.S. Pat. No. 4,096,673, all which could be of a wider range structure such as shown in U.S. Pat. No. 6,237,289, the teachings of all of which are herein incorporated by reference. Preferably the anchor shown is of the type shown in U.S. Pat. No. D572,546, and is available from Foresight Products, LLC. Alternatively the anchor could be one having greater side span of wings such as shown, for example, in U.S. Pat. No. 6,237,289. Such anchors are driven into the ground, usually by inserting a driving post (not shown herein but shown, for example, in the '673 patent) into an opening 13 in a trailing end of the anchor. When the anchor has been driven to a sufficient depth, the driving post is withdrawn. The anchor may be provided with an outturned lip 14 at its trailing end and will have an attachment point 15 on a side opposite the side of the outturned lip. The attachment point may be positioned towards the trailing end of the anchor, and a cable 16, rod or wire may be affixed to the attachment point 15 in any of a number of different connections. Smaller anchors use cables 16, which are received through eyeholes 17 at the anchor and which terminate in a closed loop 18 at the end of the cable remote from the anchor. Generally, the length of cable 16 is chosen so that only a relatively small length will extend beyond the surface 20 when the cable is fully driven into the ground.

Figure 2:
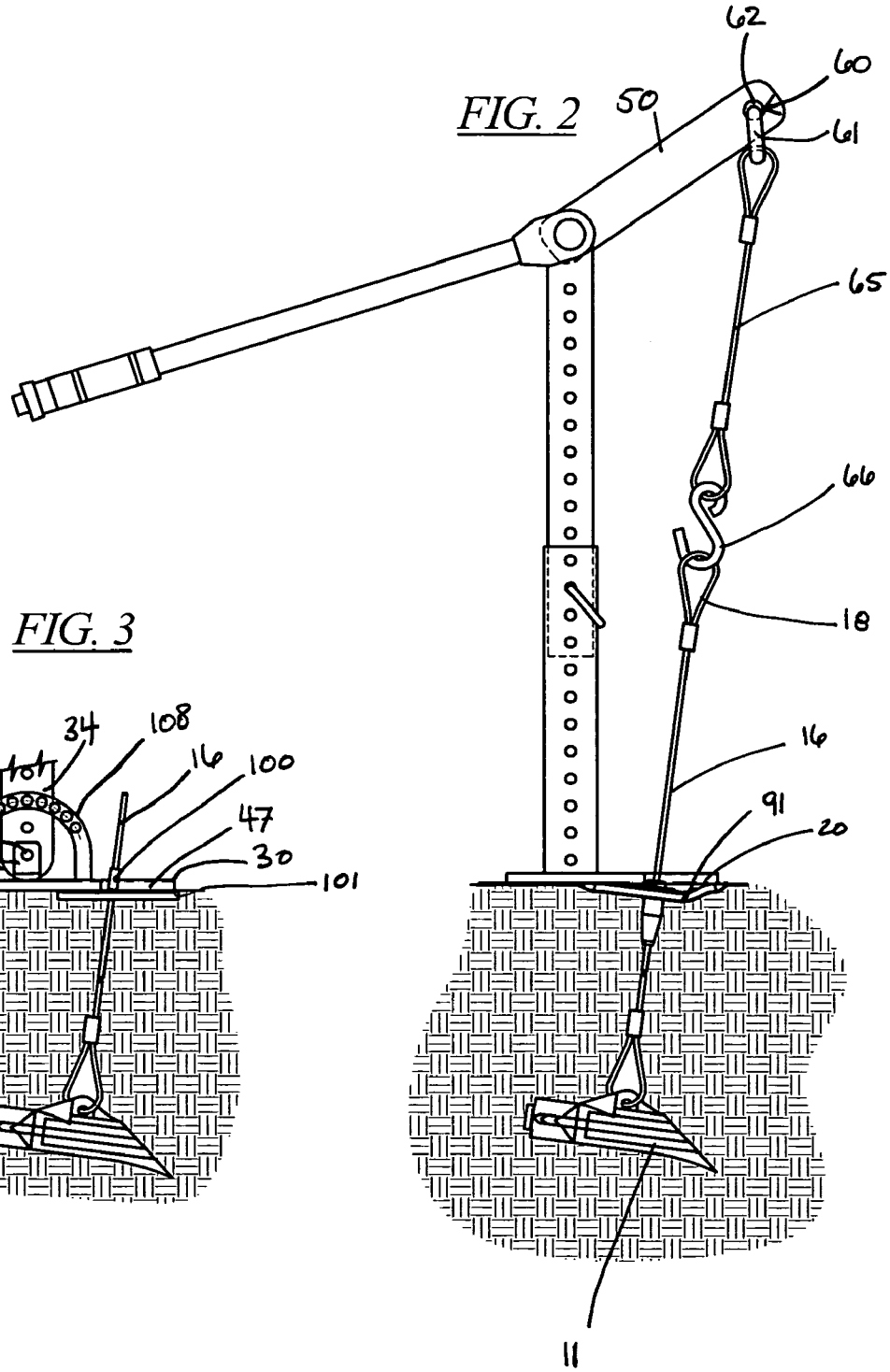
FIG. 2 is a view similar to FIG. 1 showing the structure in a tension applying position with the anchor lock in its rotated position and tension applied through a one-way cable wedge lock carried by a desk or other member showing a compression in the surface.

Applying an upward lift to the cable 16 will cause the anchor 11 to rotate in the ground to position similar to that shown in FIG. 2 where the length of the anchor from leading end to trailing end now lies generally normal to the under tension cable 16. Once the anchor has been rotated to the position shown in FIG. 2 it can be said to be set or locked in that if properly matched to the soil conditions the anchor will not be drawn further upwardly towards the surface by application of forces to the cable 16 normal to the holding specification of the given anchor.

It is desired to proof test this by application of a withdrawing force, which approximates, but does not exceed, the desired holding force.

According to the present invention, an anchor locking and load proof testing structure is provided which consists of a base member 30 to which is mounted as by welding, an upright 31 which arises above the top of the base and terminates in a top 32. As shown, the upright or post 31 may be height adjustable and may, for example, consist of telescope square posts 33 and 34 having alignable openings 35 and 36. A quick disconnect pin or snap 37 can be inserted into the aligned openings, preferably on both sides of the post to vertically adjust the setting of the upright post assembly.

Figure 4:
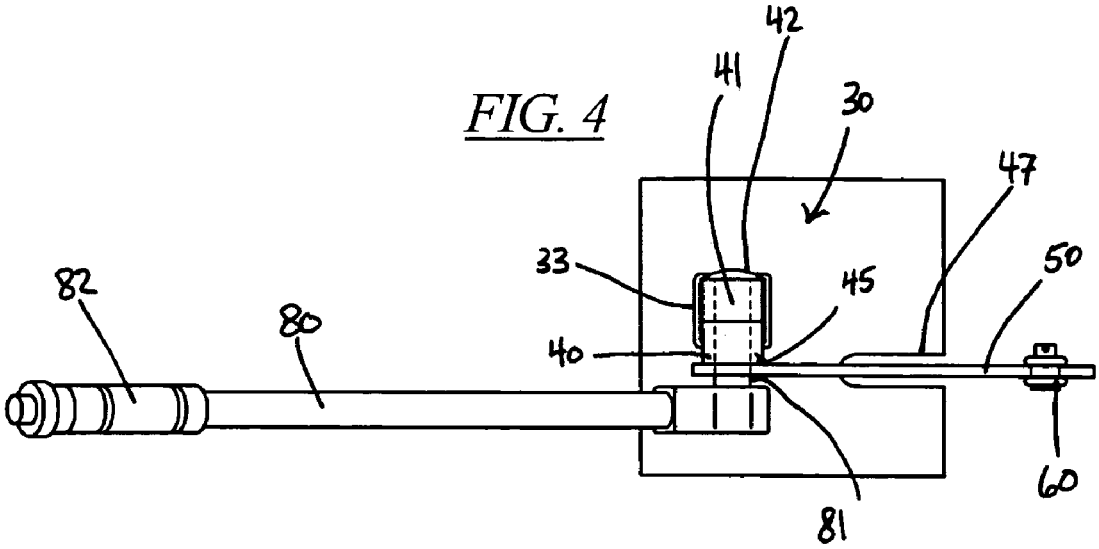
FIG. 4 is a top plan view of an anchor setting load locker and proof tester according to this invention.
Figure 5:
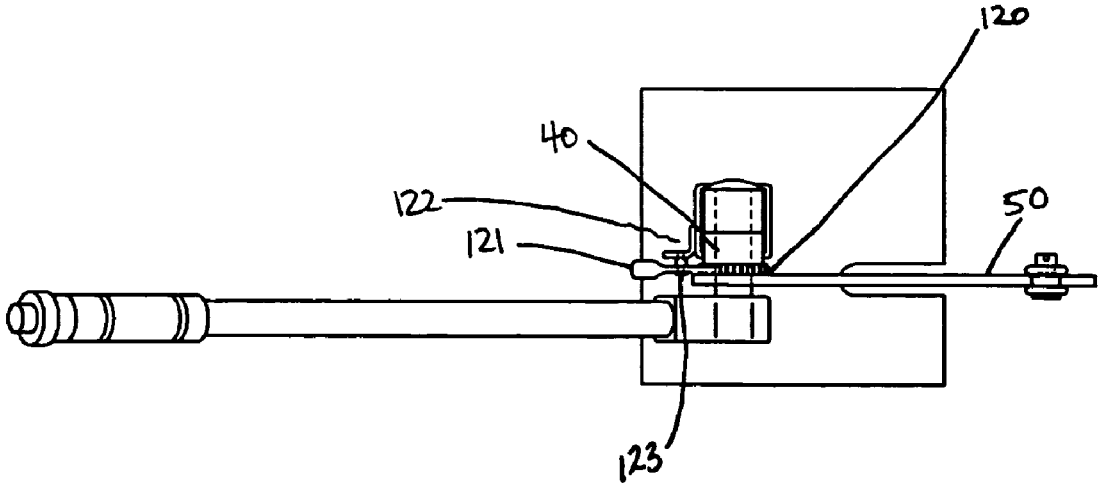
FIG. 5 is a view similar to FIG. 4 showing a ratchet and pawl lock to retain the arm in the tension applying position of FIG. 2.

As shown in FIG. 4, the top of post member 33 carries a socket member 40, which is rotatable with respect to the post. The socket may be a somewhat standard socket, may be held in a non-rotating collar 41 fixed to the post by a rivet or other headed member 42 affixed to the socket. The socket itself may be fixedly received interior of a rotating collar 45. An arm 50 is attached to the socket for rotation therewith and may, for example, be welded to the collar 45 or otherwise affixed to the socket. The arm extends outwardly beyond the post, as shown in FIGS. 1 and 2 and may overlie a slot 47 in the base 30. Slot 47 can then provide for the base to be received with the cable 16 extending upward through the slot. In this manner the arm can be swung from a position such as shown in FIG. 4 where it extends upwardly beyond the base to a position where the arm is raised above the position shown in FIG. 2 to a point where the arm cable attachment 60 may lie more vertically above the base. In the embodiment illustrated, the cable attachment 60 is a simple shackle 61 received through an opening 62 in the arm. The shackle is preferably removable or openable so that it can be attached to different intermediate cables 65 to accommodate different lengths of cable 16.

The intermediate cable 65 terminates in a hook 66, which is received through the loop end 18 of cable 16. A torsion wrench 80 of a standard design may be used with the post 81 of the wrench received in the socket 40. Such torsion wrenches are adjustable at the handle end 82 to preset maximum foot pounds of torque applied at the post 81. For a standard ground anchor 11 of a length of approximately 4-6 inches, a torque wrench having a length of about approximately 18 inches and a torque range from 20-150 foot pounds would be appropriate to work with an arm 50 of 4-6 inches in length. The torque wrench 80 is set to the desired foot pounds of torque, for example 100 foot pounds, and the wrench is then inserted into the socket as is used to rotate the socket and the arm to lift the arm to the locked position shown in FIG. 2 and to then apply a torsion load to the socket until the wrench clicks at its setting. At that point the tension on the cable is known from the setting on the torque wrench, and the anchor has been proof tested.

This invention has been found to work with a torque wrench known as a Pittsburgh clicker torque wrench with a ½ inch drive, Item No. 00239 from Harbor Freight Tools.

In place of the torque wrench, pneumatic or electric torque setting drills or drives or wrenches may be used. Such tools are commonly used, for example, in automotive shops or in industrial shops where the chuck, which may hold the socket pin, is adjustable to a given torque setting. When the torque setting is exceeded the chuck drive will click past the drive position while substantially maintaining the set torque in successive clicks.

As shown in FIG. 1, this structure may be used with a one-way cable wedge lock 90, which is affixed to a plate 91, generally 4 to 5 inches in diameter, which may lie on the surface of the ground or which may overlie a structure to be anchored to the ground such as, for example, a turf mat such as a high performance turf reinforcement mat of the type shown, for example, in U.S. Pat. No. 5,616,399. When used in that environment the mat 92 may, upon release of the tension be depressed slightly into the surface 20. The use of one-way wedge cable locks is known in the industry and, for example, a lock from Ningbo Zhongdi Industries as Model 6064 V has been found acceptable.

Figure 3:
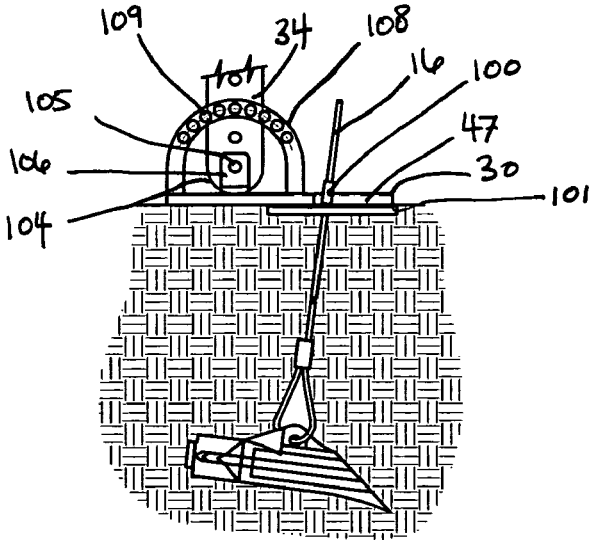
FIG. 3 is a partial view similar to FIG. 2 showing the use of a cable crimp to lock the anchor in a tensioned position.

Alternatively, it may be desired to use a crimp cable lock 100 shown in FIG. 3, which consists of a deformable sleeve received around the cable 16 and crimpable by a crimp tool into fixed position on the sleeve. Such crimp locks can be used with underlying structures 101 which may be desired to be semi-permanently held in position, such as, for example, the base member of a bicycle rack, or may simply be a plate designed to maintain the tension on the anchor until such time as another member has been secured to the free end loop 18 of the cable 16.

Normally, for example, when using reinforcement mats with one-way cable locks as shown in FIG. 2, the cable will be cut off atop the cable lock and the plate 91 will remain in place. In other instances it is desired to leave the cable 16 projecting so that it may be used for guying structures such as fence ends, trees, building walls and the like, but which will not be attached until subsequent to installation and locking of the anchor. In such instances the crimp 100 and the use of a surface plate 101 may be utilized.

In order to maintain the tension on the cable 16 during the crimping of the sleeve 100, a ratchet and pawl or other locking structure 120 may be used to hold the socket 40 in its tension position with the arm held at the full load position such as shown in FIG. 2. As shown, a simple pawl 121 may be carried on the post through a bracket 122 providing a rotation point 123 for the pawl. The pawl is engageable with the teeth of the ratchet 120 attached to the socket. In this manner the socket cannot back rotate to relieve the tension on the cable until the pawl has been lifted.

While the upright post 31 has been previously been described as rigidly fixed to the base 30 and extends upwardly therefrom, there are situations where it may be desired to have posts pivotal with respect to the base. Such situations can include installations where the base is on a sloped ground surface and it is desired to have the post extend perpendicular to level ground or in those instances where it is desired to pull the anchor at an angle other than perpendicular or normal to the ground surface. While as shown in FIG. 2 an anchor can be set and pulled at a slight angle with respect to the base when the arm 50 extends sufficiently outwardly from the edge of the base that the pulling is at an angle to the upright post, in other circumstances, for example when the anchor is to be used to guy a tree or fence end post, it will be desired that the cable 16 extend out of the ground at an angle to the ground determined by the desired height of the guy attachment and the desired distance from the attachment to the anchor. In such instances the anchor itself has normally been driven into the ground at an angle to the surface, and it will therefore be desirable to set and load the anchor with the cable at that angle.

For such situations the lower end of the post 34 as shown in FIG. 3 may be provided with a rounded bottom 104, which rests atop plate 30 and is pivotal about a pin 105 carried in a bracket 106 affixed to the base 30. The post section 34 then may be rotated about the pivot 105. An arcuate brace 108, preferably fixed to the base 30 on both sides of the post is provided with a series of openings 109 therein that can be aligned with corresponding openings 36 in the post to pin the post at an angle to the base. Thus, when the base is on level ground, the post can be angled towards or away from the slot 47 whereby the cable 16 can be tensioned in a desired angular relationship to the ground surface and to the plate 91 or structure 101.

While in the foregoing specification, embodiments of the present invention have been disclosed in considerable detail for the purpose of illustration, it will be understood by those skilled in the art that the details given herein may vary considerably within the spirit and scope of the invention. Particular details such as the construction of the plate, the upright, the arm, and the mounting of the socket for attachment of the ratcheting torque wrench or other torque applying tool may all be modified. For example, the base could be provided with spikes or cleats on its bound surface to hold it in position on the ground during the attaching process, the uprights shown as the rectangular telescope posts could be nestled respectively threaded devices, the socket attached to the upright could be a drive post, and a double socket ended connector could be utilized between the wrench drive and the post, the upright could be braced or could be in the form of a pair of uprights spanned by a horizontal member with the rotating member attached to the middle of the horizontal member. Many other adjustments and modifications will be apparent to those or ordinary skill in the art.

I claim as my invention:

1. A ground anchor setting and loading device for use with driven pivoting anchors of the type where an upward force applied to the anchor after it is driven into the ground by a rod or cable pivotally connected to the anchor and extending above the ground causes the anchor to pivot within the ground to a set position and where after setting the anchor, a continued tension force on the connection up to a predetermined tension force proof tests the setting of the anchor, the device comprising: a base member adapted to be positioned on the ground generally in the area of the exiting from the ground of a connection to an anchor driven into the ground; an upright post fixed to the base and extending upwardly therefrom, terminating in a top portion which rotatably carries a projecting arm extending outwardly over the base from the post and which is rotatable through a vertical arc; a rotatable socket affixed to the rotatable arm, the socket rotatably received in a socket retainer affixed to the post, the socket having an connection therein for attachment to the drive post of a torque applying tool, the tool having a presettable selected maximum torque, the arm terminating remote from the post and having an attachment member for attaching the arm to the connector attached to the anchor for applying a tension force to the anchor upon rotation of the arm, the maximum tension force being determined by the setting of the torsion force at the tool.

2. A device according to claim 1 wherein the tool is a torsion wrench.

3. A device according to claim 1 wherein the tool is a power driven member having a chuck drive connection which is adjustable to drive the chuck to a predetermined maximum torsion and wherein the chuck carries a post insertable into the socket.

4. A ground anchor setting and load locking device comprising a base member, an adjustable length upright post extending from the base member, a rotatable socket carried at generally the top of the post and retained to the post, an arm projecting from the post rotatable with the socket, the arm terminating in a connector adjacent a free end of the arm spaced from the post, the connector including connection for an intermediate connecting cable, the intermediate connecting cable terminating in a hook remote from the arm attachable to an end of cable having an opposite end attached to an anchor driven into the ground such that upon rotation of the arm through a vertical arc, a tension will be placed on the anchor cable, a torsion wrench detachably attachable to the socket and having an adjustable settable maximum torsion force applyable to the socket whereupon by utilizing the torsion wrench to rotate the socket, the socket rotates the arm and the arm applies an upward force to the cable to initially cause the anchor to pivot to a set position and to thereafter apply a tension force to the cable having a maximum force determined by the setting on the torsion wrench.

5. A device of claim 4 wherein the upright consists of telescope members having a detachable locking device to lock the telescoping members in different extensions of the inner member from the outer member whereby the height of the upright is adjustable.

6. A device of claim 5 wherein the socket is received in a member affixed to an upper end of the post and is rotatable in the member.

7. A device of claim 6 wherein a lock is provided to lock the socket against rotation in a direction to release tension on the cable.

8. A device of claim 7 wherein the lock is a ratchet and pawl lock having ratchet teeth with the pawl affixed to the upright and the ratchet teeth affixed to the socket, the pawl being selectively disengageable and engageable with the ratchet teeth.

9. A device of claim 8 where the base member has an opening therethrough for receipt of the anchor cable.

10. A device of claim 9 wherein the anchor cable passes through a one-way cable wedge lock affixed to a pad positionable under the base of the device whereby upon completion of load testing of the anchor, the cable is restricted from releasing the tension applied to the anchor by the cable.

11. The device of claim 4 wherein the post is pivotally attached to the base member.

12. The device of claim 11 wherein a pivot lock is provided for adjustably setting the angular pivot of the post with respect to the base and locking the post in a set angular position with respect to the post.

13. A ground anchor setting and loading device comprising: a base member; an upright post extending from the base to a post end portion spaced above the base; an arm extending outwardly from the post end portion and rotatably secured to the post adjacent one end of the arm; a connection assembly connected to a second end of the arm remote from the post and connectable to a tension member connected to an anchor driven into the ground, whereby upon rotation of the arm, an upward force can be applied to the tension member to set the anchor and to apply a tension load on the set anchor; a drive connection rotatably carried by the post and fixed to the arm, whereby rotation of the drive connection causes rotation of the arm, the drive connection detachably connected to a torsion limiting-torsion applying tool for rotating the drive connection until a set torsion force is applied to the drive resulting in a set tension load being applied to the anchor.

14. A device of claim 13 wherein the drive connection consists of a socket rotatably carried in a cylinder sleeve fixed to the post and wherein the torsion limiting tool is a torsion wrench having a drive post insertable into the socket, the socket being attached to the arm for movement therewith.

15. The method of setting and load locking a driven pivotal ground anchor, having a cable affixed thereto which comprises the steps of: driving the anchor into the ground to a predetermined depth with a cable end exiting the ground; positioning a load-applying device adjacent the portion of the cable exiting the ground; attaching the cable to an elevated arm carried by the device which is rotatable through a generally vertical arc to apply an upward force to the cable; rotatably mounting the arm to a rotatable drivable member attached to the device; applying a torsion wrench having a presettable maximum torsion load to the member; actuating the torsion wrench to apply a load to the member to rotate the member, causing a rotation of the arm to apply a tension force to the cable; moving the anchor by the tension force to a pivoted set position; continuing to apply tension force by the torsion wrench to the cable until a maximum desired tension force is achieved determined by the set torsion force on the torsion wrench.

16. The method of claim 15 wherein the load applying device includes fixing a base to the device, the base positioned over a member through which the cable projects from the anchor and wherein during the application of tension force pressing the member into the ground and applying a cable lock to the cable maintaining the cable between the anchor and the member in a tensioned condition.

* * * * *